US006343818B1

(12) United States Patent
Kuramochi

(10) Patent No.: US 6,343,818 B1
(45) Date of Patent: Feb. 5, 2002

(54) DOOR GUARD

(75) Inventor: Nobuyuki Kuramochi, Koshigaya (JP)

(73) Assignee: Sugatsune Kogyo Co., Ltd. (JP)

( * ) Notice: Subject to any disclaimer, the term of this patent is extended or adjusted under 35 U.S.C. 154(b) by 0 days.

(21) Appl. No.: 09/621,035

(22) Filed: Jul. 21, 2000

(30) Foreign Application Priority Data

Jul. 22, 1999 (JP) ..... 11-207668
May 15, 2000 (JP) ..... 2000-141187

(51) Int. Cl.[7] ..... E05F 3/00; E05F 1/10; E05C 17/04

(52) U.S. Cl. ..... 292/262; 49/386; 16/65

(58) Field of Search ..... 292/262, 338; 49/381, 386; 16/49, 65

(56) References Cited

U.S. PATENT DOCUMENTS 4,878,265 A * 11/1989 Nesbitt ..... 16/49
5,007,669 A * 4/1991 Pomerleau ..... 292/262
5,286,073 A * 2/1994 Ui ..... 292/216
5,473,841 A * 12/1995 Grillo ..... 49/394

FOREIGN PATENT DOCUMENTS

JP Hei-4-4286 12/1992

* cited by examiner

*Primary Examiner*—Christopher P. Schwartz
(74) *Attorney, Agent, or Firm*—Eugene Stephens & Associates

(57) ABSTRACT

A pivot pin (5) is pivotably provided on a door B through a support member (2). A basal end portion of a pivotal lever (3) is nonpivotably connected to the pivot pin (5). By sandwichingly holding the pivot pin (5) from its both sides by means of a plate spring (4), the pivotal lever (3) is restrained in a lock position and in a release position. The plate spring (4) biases the pivotal lever (3) towards the lock position side through the pivot pin (5), when said pivotal lever (3) is within a range where said pivotal lever (3) is offset a predetermined return angle from the lock position. The pivotal lever (3), which has been forcibly pivoted from the lock position towards the release position side by the forced pivoting portion (11*a*), is pivoted towards the lock position side by the biasing force of the plate spring (4) and a connecting portion (32) of the pivotal lever (3) is retained between an engagement pin (12) of a retaining member (1) and the forced pivoting portion (11*a*).

7 Claims, 14 Drawing Sheets

DOOR GUARD

BACKGROUND OF THE INVENTION

This invention relates to a door guard for locking a door in a predetermined half-open position (i.e., one of the positions between fully open and fully closed positions).

One example of this type of a door guard is disclosed in Japanese Utility Model Publication Hei 4-54286. This door guard comprises a retaining member fixed to a body, a pivotal lever whose basal end portion is pivotably supported by the door, and a position restricting means for restraining the pivotal lever in a lock position and in a release position with a predetermined amount of force exerted by a first biasing means. In a release position, the pivotal lever allows the door to swing freely but in a lock position, when the door is swung from a dosed position to a predetermined half-open position, the pivotal lever is pivoted by a second biasing means so as to be engaged with a retaining member. By this, the door is locked in the predetermined half-open position.

The conventional door guard includes a first biasing means for maintaining the pivotal lever in the lock position or in the release position, and a second biasing means for pivoting the pivotal lever so as to be engaged with the retaining member when the door is swung to the predetermined half-open position. If those two biasing means can be replaced by only one biasing means, parts can be reduced in number and therefore, the manufacturing costs can be reduced to that extent.

SUMMARY OF THE INVENTION

The subject matter of the present invention resides in a door guard comprising:

a retaining member fixed to a body;

a pivotal lever whose basal end portion is pivotably supported by a door;

position restricting means including biasing means, the position restricting means restraining the pivotal lever in a lock position and in a release position with a predetermined amount of force exerted by the biasing means, the biasing means biasing the pivotal lever such that the pivotal lever returns to the lock position within a range of a predetermined return angle from the lock position;

forced pivoting means, when the door is swung from the closed position to the open position in a state in which the pivotal lever is pivoted to the lock position, the forced pivoting means pivoting the pivotal lever within a range of the return angle from the lock position against the biasing force of the biasing means as the door is swung open and when the door reaches the half-open position, the forced pivoting means allowing the pivotal lever to pivot to the lock position side by the biasing force of the biasing means; and the retaining member being formed with an engagement portion, when the pivotal lever, which has been pivoted from the lock position by the forced pivoting means, is pivoted to the lock position side by the biasing means, the engagement portion being brought into engagement with the pivotal lever to prevent the pivotal lever from moving in a swinging direction of the door.

It is preferred that the position restricting means includes the biasing means and a pivot pin pivotably supported by the door and nonpivotably disposed on the basal end portion of the pivotal lever, thereby pivotably connecting the pivotal lever to the door; and the pivot pin having a first and a second position restricting portion which are formed on an outer peripheral surface thereof in such a manner as to be away from each other in a circumferential direction of the pivot pin; and the biasing means restraining the pivotal lever in the lock position by being abutted with the first position restricting portion under the effect of its own biasing force and restraining the pivotal lever in the release position by being abutted with the second position restricting portion.

It is also preferred that two of the first and second position restricting means are provided, the two first restricting means are arranged about 180 degrees away from each other in a circumferential direction of the pivot pin and the two second restricting means are likewise arranged about 180 degrees away from each other in the circumferential direction of the pivot pin, and the first and second position restricting means are alternately arranged in the circumferential direction of the pivot pin.

It is also preferred that the forced pivoting means includes a forced pivoting portion disposed on the retaining member, when the door is swung open from a closed position in a state in which the pivotal lever is pivoted in the lock position, the forced pivoting portion being brought into contact with the pivotal lever to thereby pivot the pivotal lever out of the lock position.

It is also preferred that in a neutral position where the lever is away by the return angle from the lock position to the release position side, the position restricting means restrains the pivotal lever in the neutral position, when the pivotal lever is pivoted from the neutral position to the lock position, the biasing means biases the pivotal lever to the lock position side and when the pivotal lever is pivoted from the neutral position to the release position side, the biasing means biases the pivotal lever to the release position side, and the pivotal lever is provided with an abutment portion which is abutted with the retaining member when the door is swung open from the closed position in a state in which the pivotal lever is pivoted to the neutral position.

It is also preferred that the abutment portion projects towards the retaining member side.

It is also preferred that the position restricting means restrains the pivotal lever in a stable position between the neutral position and the release position by a biasing force of a predetermined value of the biasing means.

DETAILED DESCRIPTION OF THE INVENTION

The embodiments of the present invention will now be described with reference to FIGS. 1 to 21.

Figure 1:
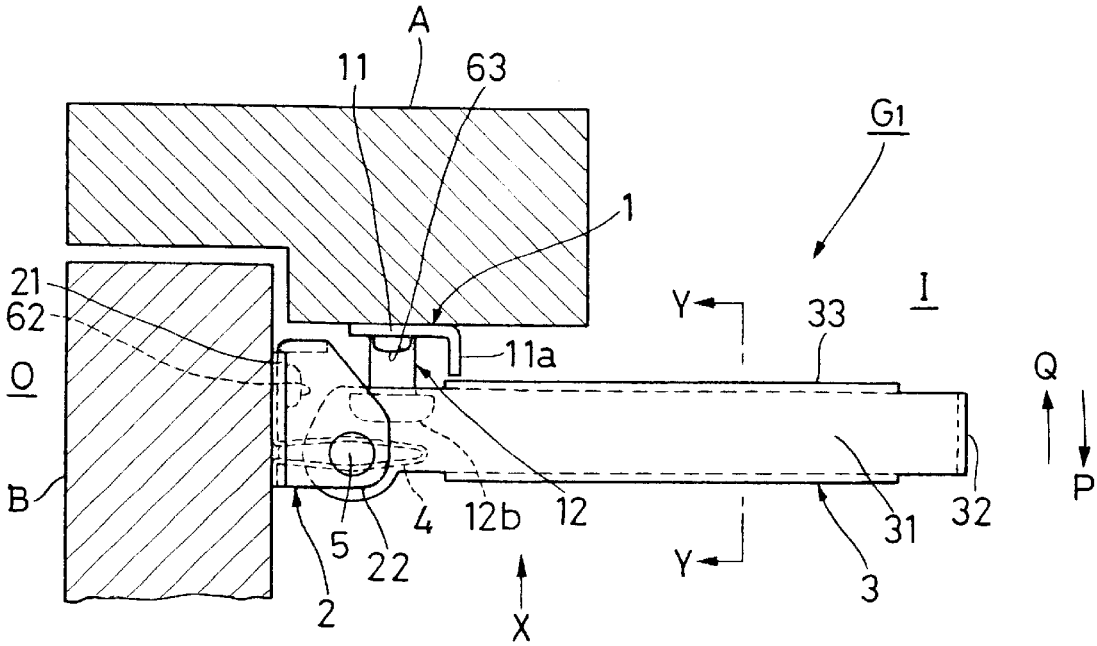
FIG. 1 is a plan view of a first embodiment of the present invention, showing a state in which a pivotal lever is pivoted to a lock position.
Figure 2:
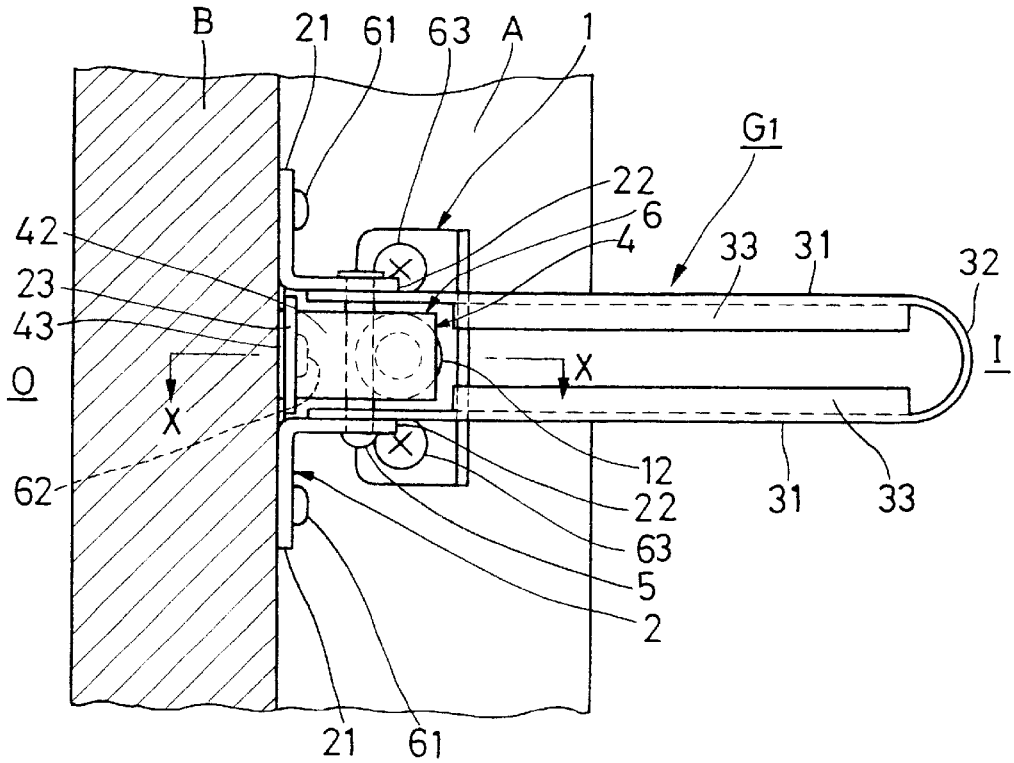
FIG. 2 is an illustration when viewed in a direction as indicated by an arrow X of FIG. 1.
Figure 3:
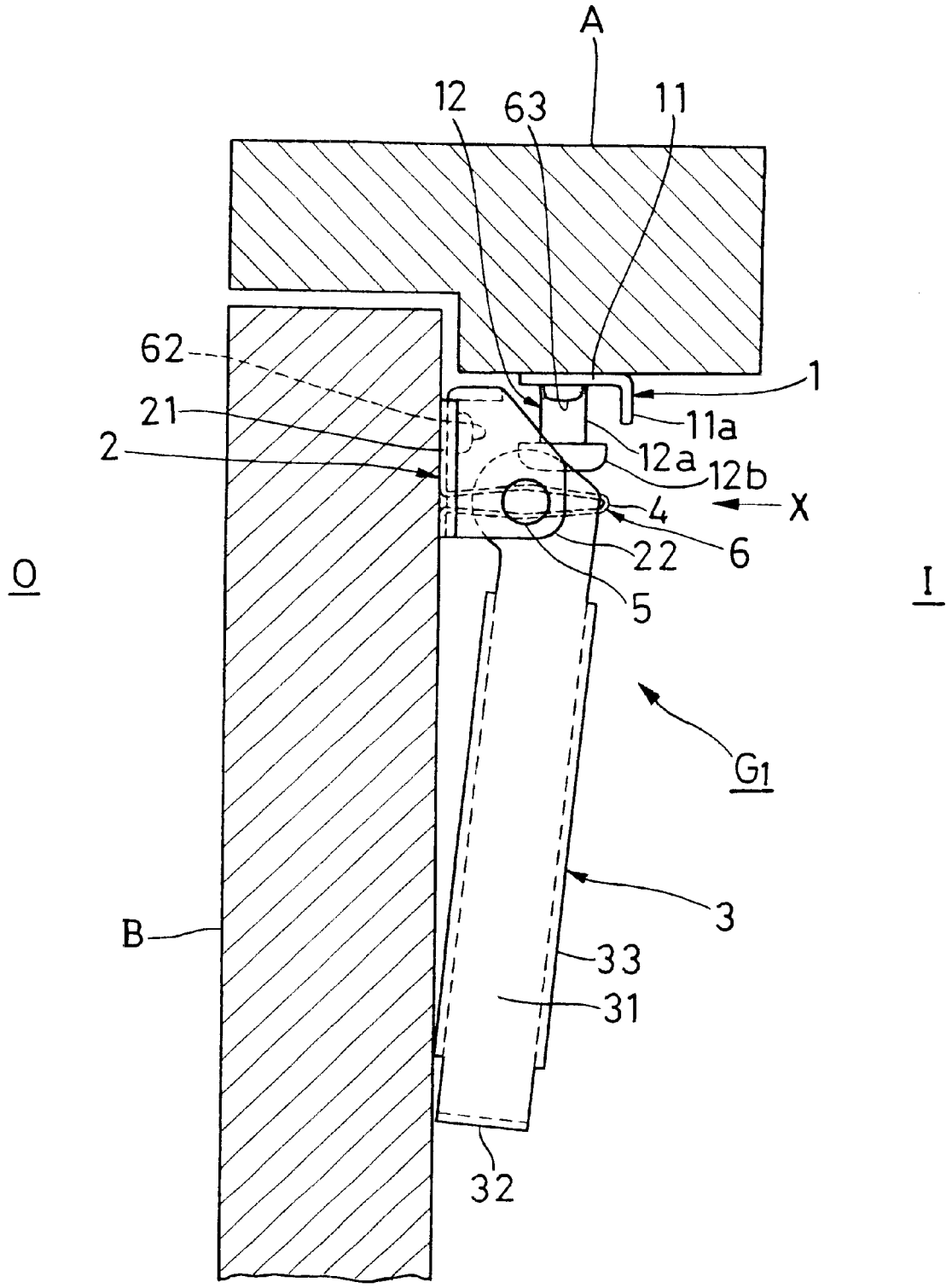
FIG. 3 is a plan view of the first embodiment of the present invention, showing a state in which the pivotal lever is pivoted to a release position.

First, a first embodiment shown in FIGS. 1 to 12 is described. A door guard $G_1$ of this embodiment, as shown in FIGS. 1 to 3, is adapted to maintain a door B, which is swingably attached to an opening portion of a door frame (body) A on its outdoor O side, in a predetermined half-open position of FIG. 9. The door guard $G_1$ includes a retaining member 1 fixed to the door frame A, a support member 2 attached to a free end portion of the door B and a pivotal lever 3 whose basal end portion is horizontally pivotably disposed on the support member 2.

Figure 7:
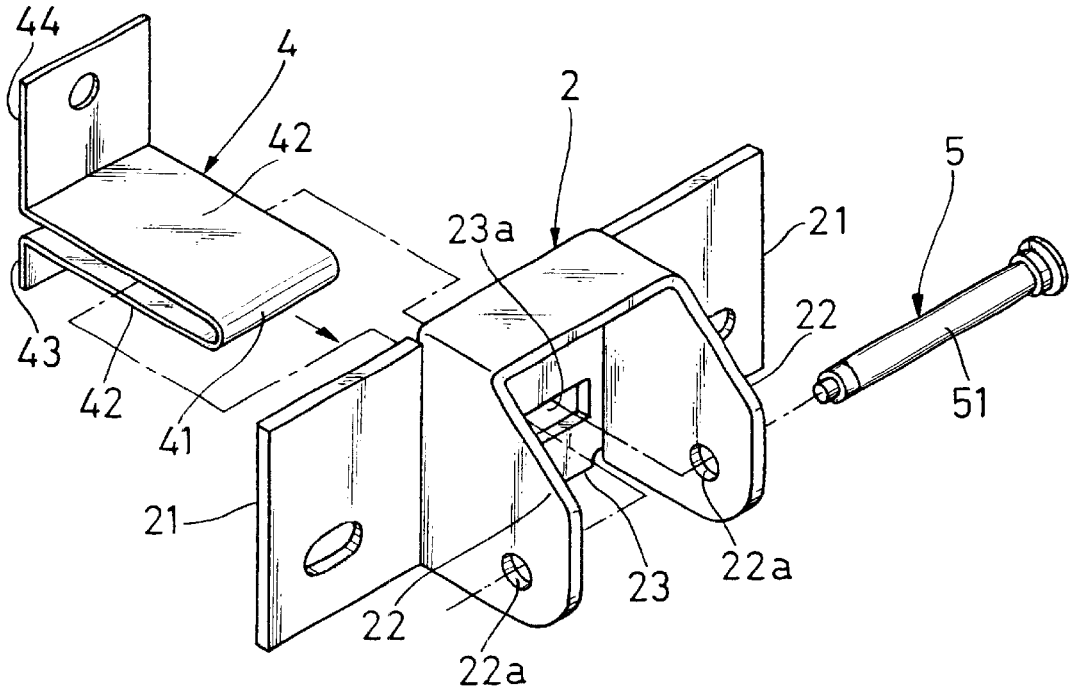
FIG. 7 is an exploded perspective view showing a support member, a plate spring and a pivot pin.
Figure 8:
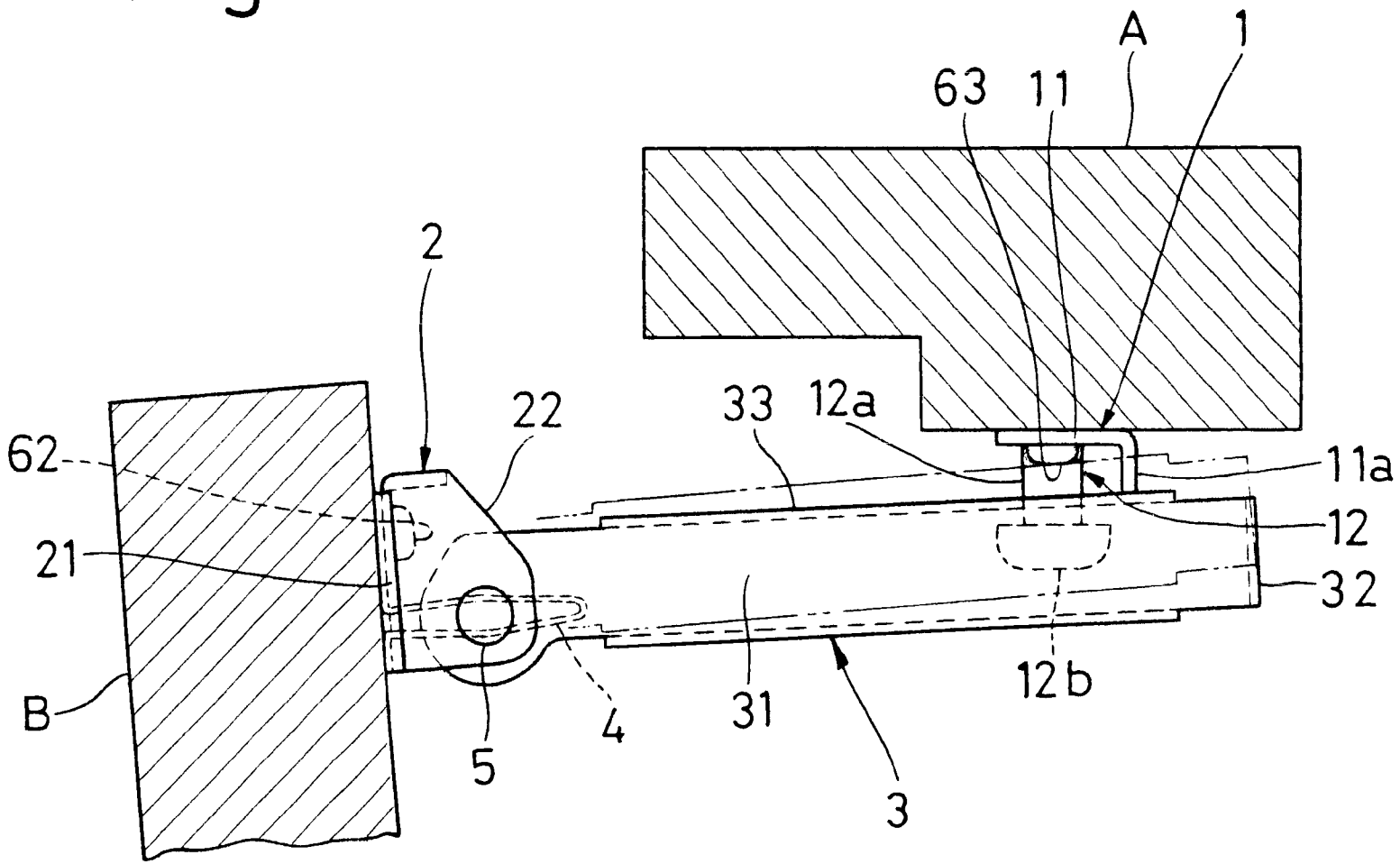
FIG. 8 is a plan view of the first embodiment of the present invention, showing a state in which a door is swung to a position immediately before a half-open position with the pivotal lever held in the lock position.

The support member 2 is composed by bend-machining a metal plate. It has one pair of stationary plate portions 21, 21 as shown in FIG. 7. The stationary plate portions 21, 21 are arranged in vertical relation to each other and fixed to that surface of the door B facing the indoor I by machine screws 61 (see FIG. 2). Vertically opposing support plate portions 22, 22 are formed on vertically adjacent end portions of the stationary plate portions 21, 21, respectively. A sandwiching plate portion 23 is formed between the support plate portions 22, 22. The sandwiching plate portion 23 is in parallel relation to each stationary plate portion 21 and arranged in such a manner as to be slightly away towards the indoor I side with respect to the stationary plate portion 21.

Figure 6:
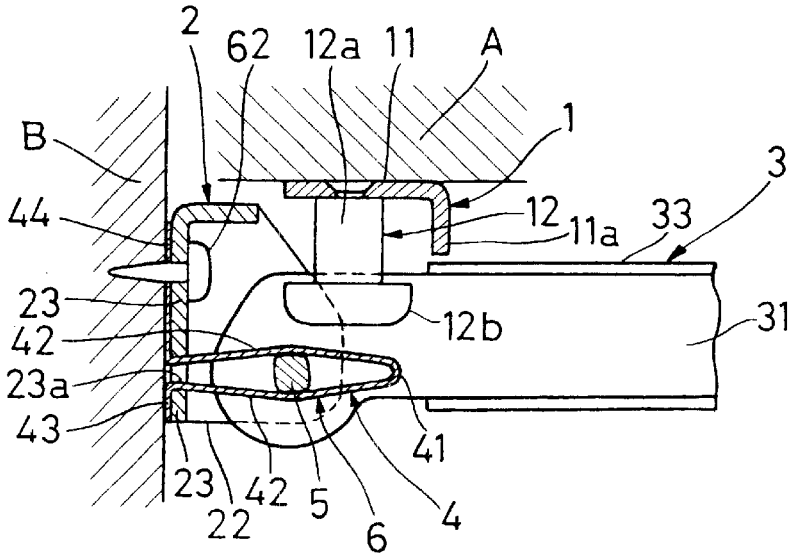
FIG. 6 is a sectional view taken on line X—X of FIG. 2.

As shown in FIG. 6, a plate spring (biasing means) 4 is fixingly sandwiched by and between the sandwiching plate portion 23 of the support member 2. That is, the plate spring 4, as shown in FIG. 7, is comprised of a vertically extending connecting portion 41 having a semi-circular configuration in section, one pair of parallel plate portions 42, 42 extending in mutually parallel relation towards the outdoor O side from opposite side portions of the connecting portion 41, and leg plate portions 43, 44 bent at right angles in a direction away from the end portions of the parallel plate portions 42, 42. As shown in FIG. 6, the leg plate portions 43, 44 are fixingly sandwiched between the door B and the sandwiching plate portion 23 by tightening a machine screw 62 which is threadingly engaged with the door B via both the sandwiching plate portion 23 and the leg plate portion 44. The parallel plate portions 42, 42 are inserted into a restriction hole 23*a* of the sandwiching plate portion 23 from the outdoor O side.

Figure 10:
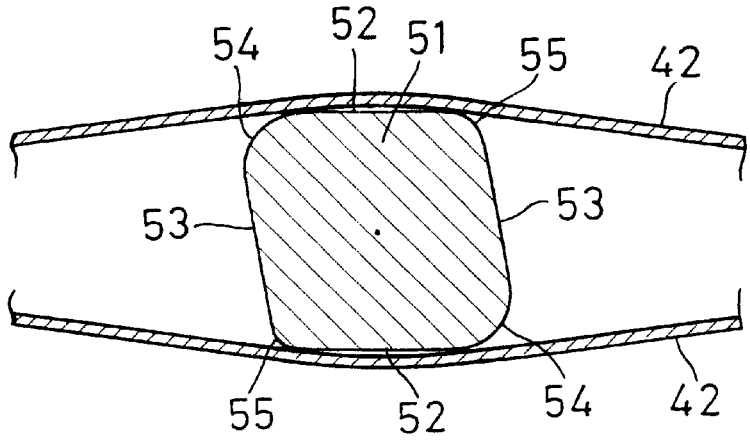
FIG. 10 is a sectional view showing a relation between a plate spring and a pivot pin when the pivotal lever of the first embodiment of the present invention is pivoted to the lock position.
Figure 11:
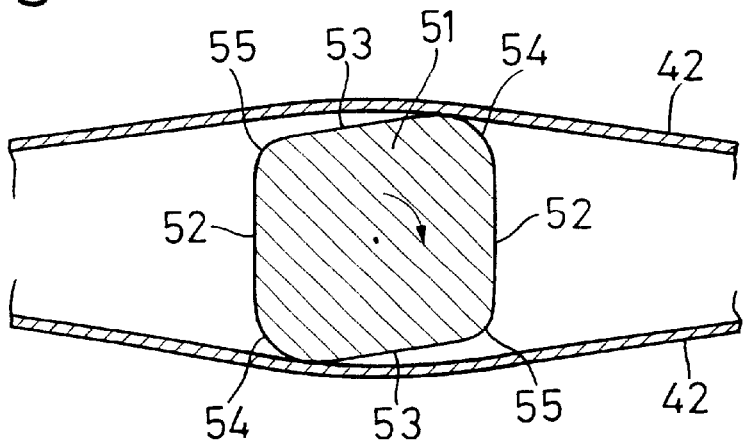
FIG. 11 is a sectional view showing a relation between the plate spring and the pivot pin when the pivotal lever of the first embodiment of the present invention is pivoted to the release position.
Figure 12:
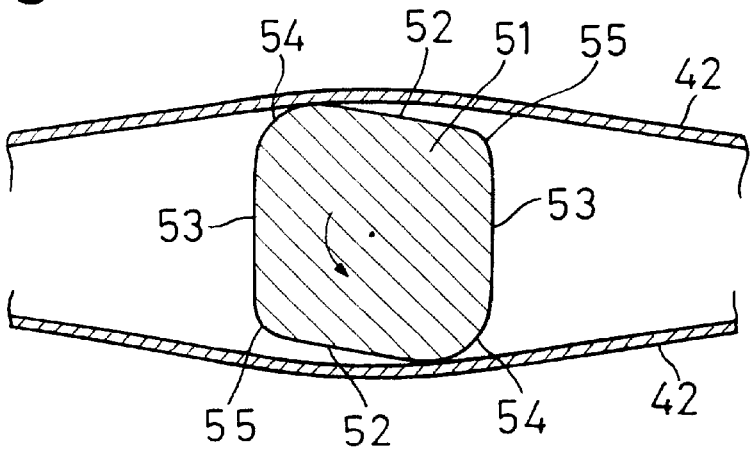
FIG. 12 is a sectional view showing a relation between a plate spring and a pivot pin when the door is pivoted to a position immediately before the half-open position with the pivotal lever of the first embodiment of the present invention held in the lock position.

As shown in FIG. 7, each support plate portion 22 is formed with a support hole 22*a* having a vertical axis. Opposite end portions of the pivot pin 5 are pivotably inserted in the respective support holes 22*a*. An intermediate portion of the pivot pin 5 located between the support holes 22*a*, 22*a* serves as a pivotal movement restricting portion 51. As shown in FIGS. 10 to 12, the pivotal movement restricting portion 51 exhibits a parallelogrammic configuration and has one pair of first planar portions (first position restricting portion) 52, 52 and one pair of second planar portions (second position restricting portion) 53, 53 formed on an outer peripheral surface thereof The first planar portions 52, 52 are in parallel relation to each other and arranged 180 degrees away from each other in a circumferential direction of the pivot pin 5. The second planar portions 53, 53 are also in parallel relation to each other and arranged 180 degrees away from each other in a circumferential direction of the pivot pin 5. The first planar portion 52 and the second planar portion 53 are alternately arranged in the circumferential direction of the pivot pin 5. An arcuate portions 54 is formed between one end portion of the first planar portion 52 and the second planar portion 53. An arcuate portion 55 is formed between the other end portion of the first planar portion 52 and the second planar portion 53. The arcuate portions 54, 55 smoothly contact the first and second planar portions 52, 53.

The pivotal movement restricting portion 51 of the pivot pin 5 is vertically inserted such that it extends between central portions of the parallel plate portions 42, 42 of the plate spring 4. The width of the pivotal movement restricting portion 51 is dimensioned larger than an interval between the parallel plate portions 42, 42. Owing to this feature, the pivotal movement restricting portion 51 is sandwiching held by the parallel plate portions 42, 42 of the plate spring 4 from vertical opposite sides thereof. The sandwichingly holding mode will be described hereinafter in detail.

As shown in FIGS. 1 to 5, the pivotal lever 3 includes one pair of vertically mutually opposing parallel arm portions 31, 31, and a semi-circular connecting portion 32 for connecting one end portions of the one pair of arm portions 31, 31 together. The pivotal lever 3 exhibits an elongated U-shaped configuration. The other end portions (basal end portion of the pivotal lever 3) of the arm portions 31, 31 are nonpivotably connected to the pivot pin 5. Accordingly, the pivotal lever 3 is pivotably supported by the support member 2 for horizontal pivotal movement about the pivot pin 5. As a consequence, when the pivotal lever 5 is pivoted, the pivot pin 5 is also pivoted.

When the pivotal lever 3 is pivoted to the lock position in which the pivotal lever 3 is lengthwise generally orthogonal to the door B as shown in FIG. 1 and when the pivotal lever 3 is pivoted to the release position in which a distal end portion of the pivotal lever 3 is in abutment with the door 3 as shown in FIG. 3, the pivotal lever 3 is restrained with a predetermined amount of force exerted by a position restricting means 6 having the plate spring 4 and the pivot pin 5.

More specifically, when the pivotal lever 3 is in the lock position of FIG. 1, the parallel plate portions 42, 42 of the plate spring 4 are in abutment with opposite end portions of the first planar portions 52, 52 as shown in FIG. 10. As a consequence, the pivot pin 5 is restrained (nonpivotably locked in position) with a predetermined amount of force and thus, the pivotal lever 3 is restrained in the lock position. Moreover, even if the pivotal lever 3 is brought out of the lock position, the pivotal lever 3 is returned to the lock position within a range of a predetermined return angle until the arcuate portions 54, 54 or 55, 55 are brought into contact with the central portions of the respective parallel plate portions 42, 42.

On the other hand, when the pivotal lever 3 is in the release position as shown in FIG. 3, the pivot pin 5 is pivoted about 90 degrees from the lock position. As a consequence, the parallel plate portions 42, 42 are brought into abutment with the second planar portions 53, 53 as shown in FIG. 11. Since the angle formed between the first planar portions 52 and the second planar portion 53 is smaller than 90 degrees, the parallel plate portions 42, 42 are brought into abutment with only one end portions (end portions on the arcuate portion 54 side) of the second planar portions 53, 53. As a consequence, the plate spring 4 biases the pivot pin 5 so as to be pivoted in a direction as indicated by an arrow of FIG. 11. This pivotal biasing force causes the distal end portion of the pivotal lever 3 to be abutted with the door B, thereby maintaining the pivotal lever 3 in the release position.

The pivotal position when the pivotal lever 3 is parallel to the door B may be the release position. In this case, it may be designed such that when the pivotal lever 3 is pivoted to the release position, the parallel plate portions 43, 43 are brought into abutment with the opposite end portions of the second planar portions 53, 53, respectively. The pivotal lever 3, which is restrained in the lock position or in the release position, can be pivoted by exerting a larger force than the biasing force of the plate spring 4 to the pivotal lever 3.

In the state in which the pivotal lever 3 is pivoted to the release position, the door B can be swung open and shut freely. However, in the state in which the pivotal lever 3 is pivoted to the lock position, when the door B is swung open to a predetermined half-open position from the shut position, the pivotal lever 3 is retained by the retaining member 1 and the door B is held in the half-open position as hereinafter described.

As shown in FIGS. 1 to 5, the retaining member 1 includes a stationary plate 11 and an engagement pin (engagement portion) 12. The stationary plate 11 is fixed to an inner surface at one side portion (side portion on the free end portion side of the door B) of the door frame A by machine screws 63. The engagement pin 12 is comprised of a pin portion 12*a* fixedly erected from the stationary plate 11 towards the rotary lever 3 side and a head portion 12*b* formed on a distal end portion of the pin portion 12*a*. The head portion 12*b* is arranged such that when the door B is in the shut position, the head portion 12*b* is brought into between basal end portions of the one pair of arm portions 31, 31 of the pivotal lever 3 irrespective of the pivotal position of the pivotal lever 3 as shown in FIGS. 1 and 3.

Figure 5:
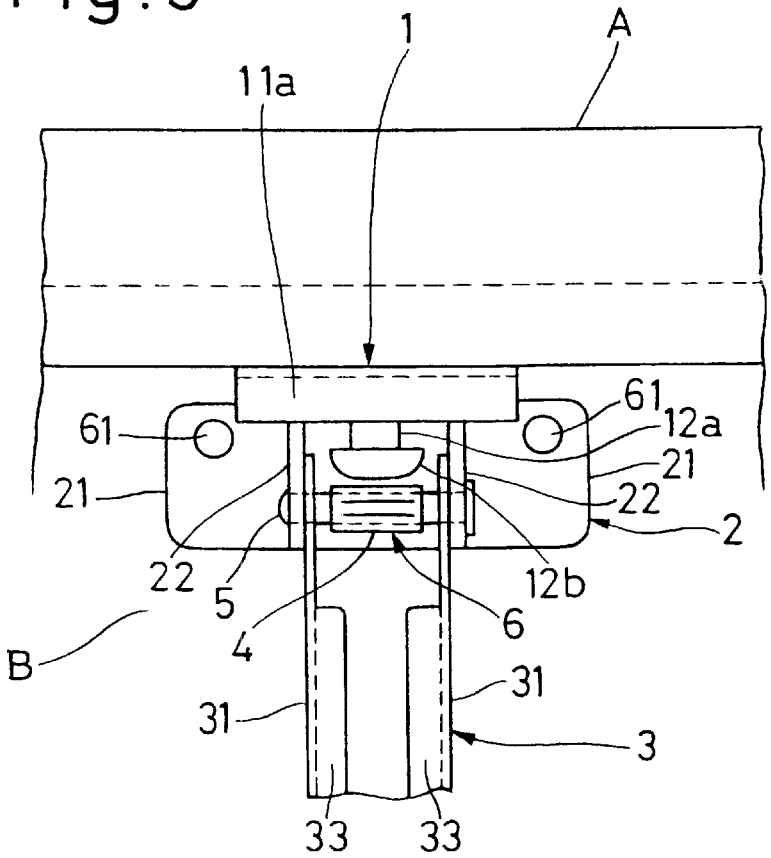
FIG. 5 is an illustration when viewed in a direction as indicated by an arrow X of FIG. 3.

As shown in FIGS. 3 and 5, in the state in which the pivotal lever 3 is in the release position, the pivotal lever 3 is not brought into engagement with the retaining member 1. Accordingly, the door 3 can be swung open and shut freely.

Figure 4:
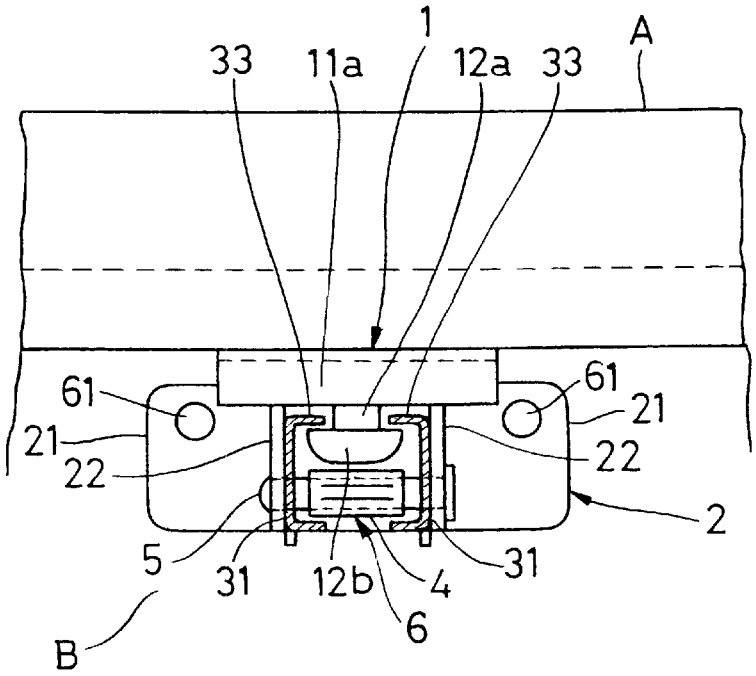
FIG. 4 is a sectional view taken on line Y—Y of FIG. 1.

In the state in which the pivotal lever 3 is in the lock position, when the door B is swung open from the shut position, the pivotal lever 3 is brought into engagement with the retaining member 1. That is, as shown in FIGS. 1, 2 and 4, the arm portions 31, 31 are formed at respective side portions thereof on the door frame A side with engagement plate portions 33, 33 which project towards each other from the arm portions 31, 31. The engagement plate portions 33, 33 are located somewhat on the door frame A side from the head portion 12*b* when the pivotal lever 3 is pivoted to the lock position. Moreover, the interval between the engagement plates 33, 33 is dimensioned larger than the outside diameter of the pin portion 12*a* but smaller than the outside diameter of the head portion 12*b*. Accordingly, when the door B is swung open from the shut position in the state in which the pivotal lever 3 is pivoted to the lock position, the pin portion 12*a* is brought into between the engagement plate portions 33, 33 and the head portion 12*b* is brought into the interior of the pivotal lever 3 so as to be faced with the engagement plate portions 33, 33. As a consequence, the pivotal movement of the pivotal lever 3 from the lock position to the release position side (the direction as indicated by the arrow P of FIG. 1) is prevented by abutment of the head portion 12*b* with the engagement plate portion 33. The reversal pivotal movement of the pivotal lever 3 from the lock position to the release position side (the direction as indicated by the arrow Q of FIG. 1) is prevented by the abutment of the pivotal lever 3 with the retaining member 1. Accordingly, the pivotal lever 3 does not pivot a large amount from the lock position. Of course, it never happens that the pivotal lever 3 pivots exceeding the above-mentioned return angle from the lock position.

Since the pivotal lever 3 is maintained in the lock position by the position restricting means 6 including the plate spring 4 and the pivot pin 5, it is not absolutely necessary that the pivotal movement of the pivotal lever 3 from the lock position to the release position side is prevented by the engagement plate portions 33, 33 and the head portion 12*b* of the engagement pin 12 and that the pivotal movement exceeding the lock position is prevented by the retaining member 1.

As shown in FIGS. 1 and 6, a forced pivoting portion (forced pivoting means) 11*a* is erected from an end portion on the indoor I side of the stationary plate 11 towards the pivotal lever 3. This forced pivoting portion 11*a* is arranged such that when the door B is in the shut position and the pivotal lever 3 is in the lock position, its distal end portion is generally in contact with the engagement plate portion 33. Accordingly, when the door B is swung open from the shut position with the pivotal lever 3 pivoted to the lock position 3, the distal end side portion of the pivotal lever 3 is brought towards the retaining member 1 as the door B is swung open and brought into abutment with the distal end face of the forced pivoting portion 11*a*. When the door B is further swung open, the pivotal lever 3 is forcibly rotated from the lock position to the release position side by the forced rotating portion 11*a*. It should be noted that the angle which the pivotal lever 3 is caused to pivot by the forced pivoting portion 11*a* is smaller than the above-mentioned return angle. Accordingly, the rotary lever 3 is pivotally biased towards the lock position side by the plate spring 4.

Figure 9:
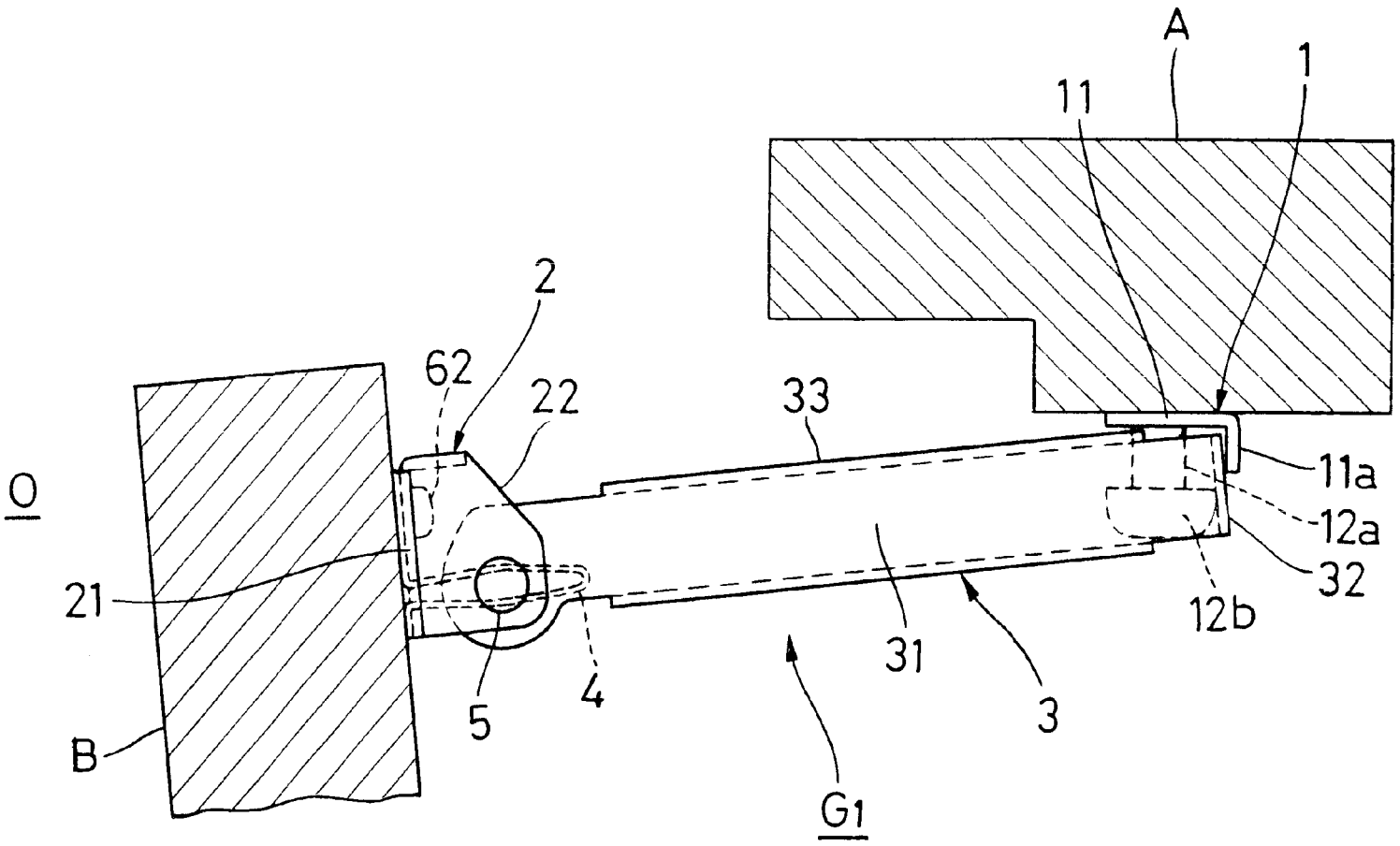
FIG. 9 is a plan view of the first embodiment of the present invention, showing a state in which a door is swung to a half-open position with the pivotal lever held in the lock position.

When the door B is swung open to the predetermined half-open position of FIG. 9, the engagement plate 33 of the pivotal lever 3 is offset towards the outdoor O side from the forced pivoting portion 11*a*, thereby allowing the pivotal lever 3 to pivot to the lock position side from the release position side. Then, the pivotal lever 3 is caused to pivot to the lock position side by the plate spring 4. When the pivotal lever 3 is pivoted towards the lock position side until the pivotal lever 3 is brought into abutment with the stationary plate 11 or when the pivotal lever 3 is pivoted to the lock position, the connecting portion 32 is brought into between the head portion 12*b* and the forced pivoting portion 11*a*. In that state, the movement of the pivotal lever 3 towards the indoor I side is prevented by the abutment of the connecting portion 32 with the forced pivoting portion 11*a*, while the movement of the pivotal lever 3 towards the outdoor O side is prevented by the abutment of the connecting portion 32 with the head portion 12*b*. Moreover, the interval between the head portion 12*b* and the forced pivoting portion 11*a* is set generally equal to the thickness of the connecting portion 32. Accordingly, the pivotal arm 3 can hardly move towards the indoor/outdoor direction (swinging direction of the door B) and the door B is positionally locked to the half-open position. As apparent from this, in this embodiment, the forced pivoting portion 11*a* and the head portion 12*b* serve as the engagement portion for preventing the pivotal lever 3 from moving in the swinging direction of the door B.

For releasing the retained state of the pivotal lever 3 by the retaining member 1, first, the pivotal lever 3 is pivoted towards the release position side against the biasing force of the plate spring 4. Subsequently, the pivotal lever 3 is pivoted until the engagement plate portion 33 is brought into abutment or nearly abutment with the head portion 12*b*. Then, the connecting portion 32 is caused to move towards the release position side beyond the distal end of the forced pivoting portion 11*a*, thereby releasing the engaged state therebetween. Accordingly, the pivotal lever 3 can be moved towards the indoor I side and the door B can be swung shut. When the door B is pivoted to the shut position, the head portion 12*b* is moved towards the outdoor O side beyond the engagement plate portion 33 and the engaged state therebetween is released. As a consequence, the pivotal lever 3 can pivot towards the release position side.

In the door guard $G_1$ thus constructed, the plate spring 4 restrains the pivotal lever 3 in both the lock position and the release position. Moreover, when the door B is swung to the predetermined half-open position, the plate spring 4 causes the pivotal lever 3 to be pivoted to the lock position side. That is, the plate spring 4 serves as two biasing means, one for restraining the pivotal lever 3 in both the lock position and the release position and the other for returning the pivotal lever 3 to the lock position side when the door 3 is swung to the half-open position. Therefore, since the number of the biasing means can be reduced, the structure of the door guard $G_1$ can be simplified and the manufacturing costs can be lowered to that extent. In addition, since the forced pivoting portion 11*a* serving as the forced pivoting means also commonly serves as the engagement portion for retaining the pivotal lever 3, the structure of the door guard $G_1$ can be more simplified and the manufacturing costs can be more lowered.

FIGS. 13 to 20 show a second embodiment of the present invention. In the door guard $G_2$ of this embodiment, the pivotal lever 3 is provided at a distal end portion thereof with a cushion member 7 made of resilient material such as rubber. When the door B is swung to the half-open position from the shut position in the state in which the pivotal lever 3 is in the lock position, the connecting portion 32 is brought into abutment with the head portion 12*b* through the cushion member 7. The cushion member 7 attenuates the impact which occurs when the connecting portion 32 is abutted with the head portion 12*b*. The cushion member 7 is brought into between the head portion 12*b* and the forced pivoting portion 11*a* together with the connecting portion 32, thereby preventing the pivotal lever 3 from moving in the outdoor direction. Thereby, the door 3 is positionally locked to the half-open position.

Figure 13:
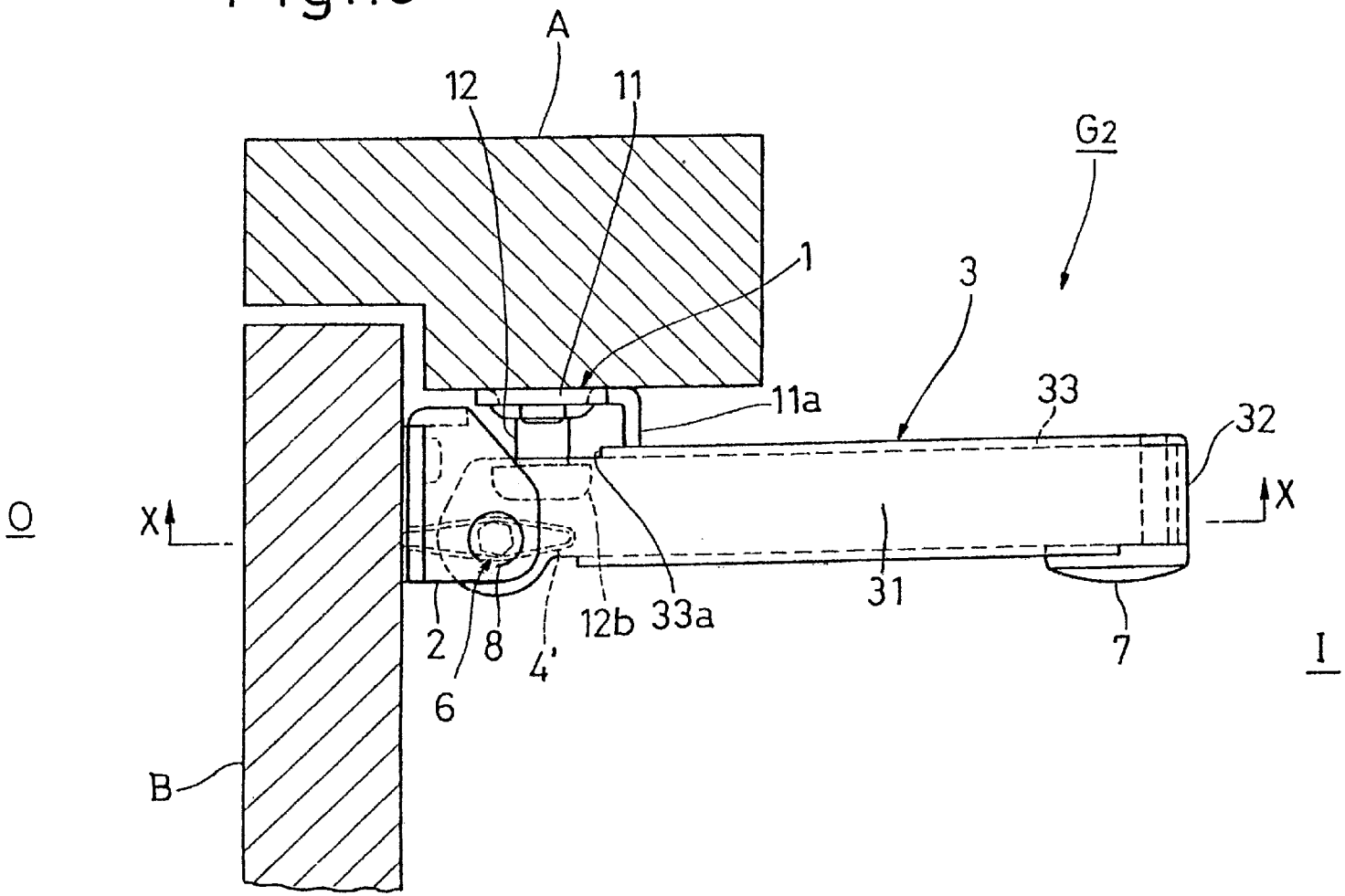
FIG. 13 is a plan view of a second embodiment of the present invention, showing a state in which the pivotal lever is pivoted to the lock position.
Figure 14:
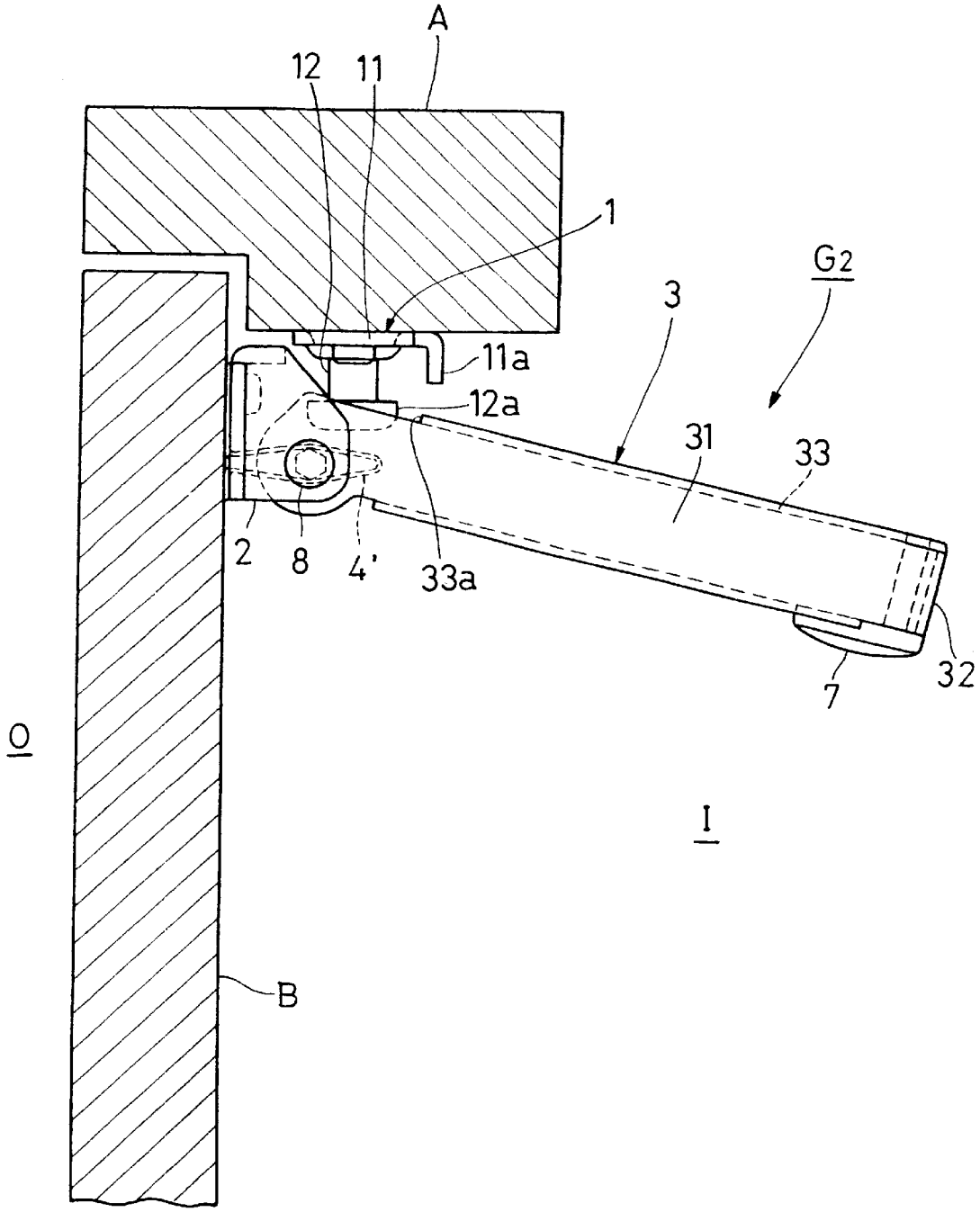
FIG. 14 is a plan view of the second embodiment of the present invention, showing a state in which the pivotal lever is pivoted to the neutral position.
Figure 15:
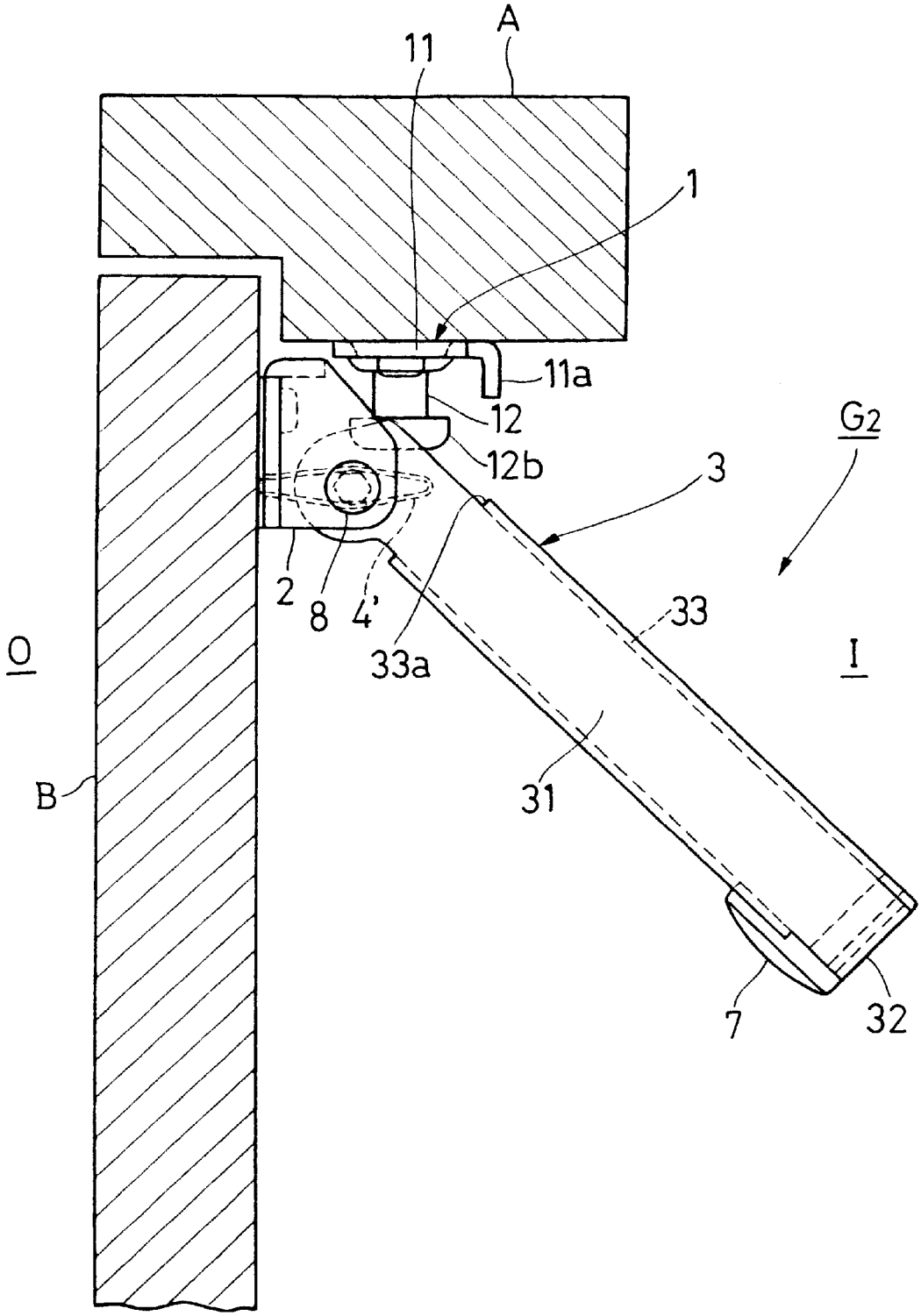
FIG. 15 is a plan view of the second embodiment of the present invention, showing a state in which the pivotal lever is pivoted to the stable position.
Figure 16:
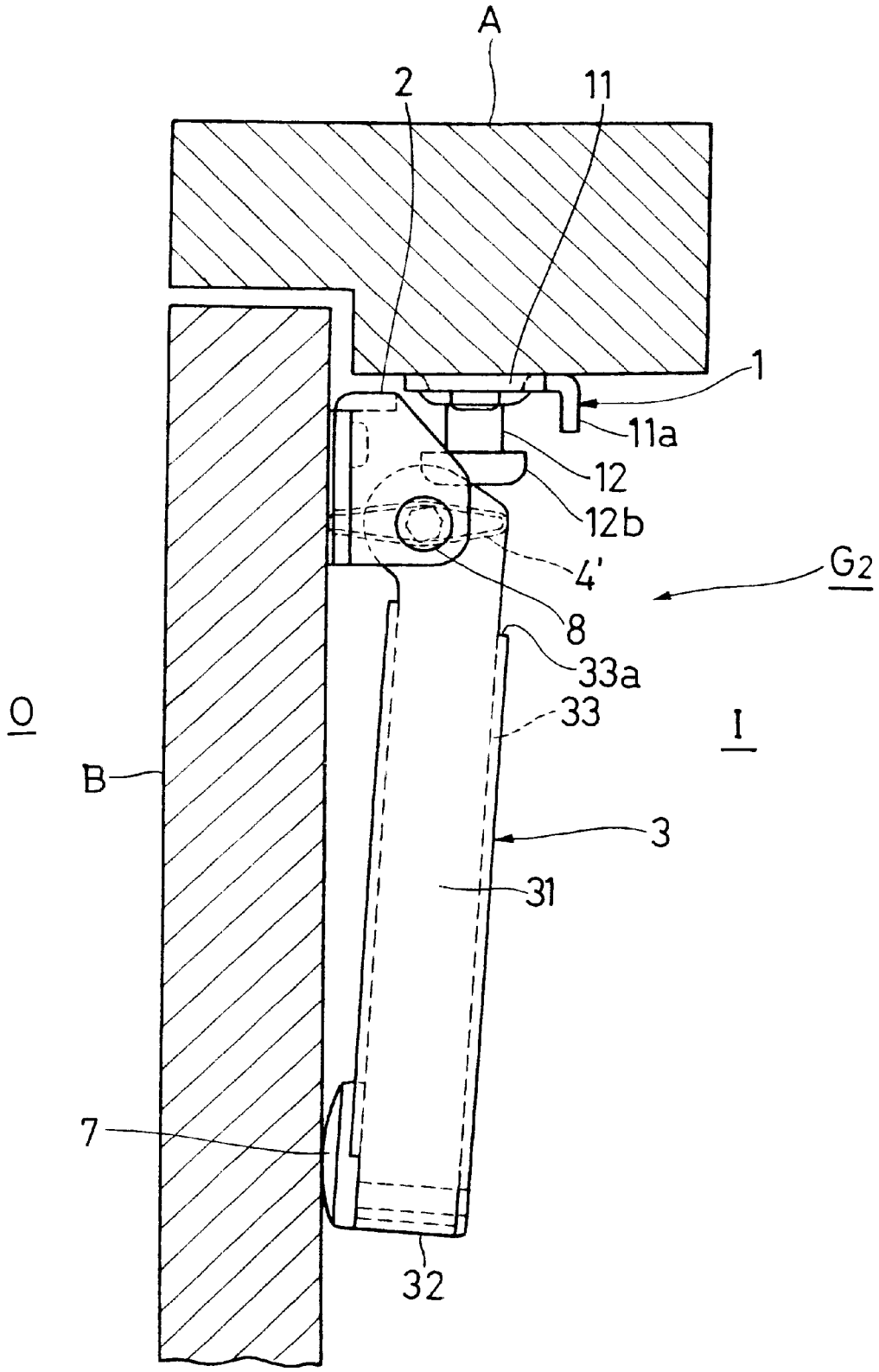
FIG. 16 is a plan view of the second embodiment of the present invention, showing a state in which the pivotal lever is pivoted to the release position.

The pivotal lever 3 is positionally restrained not only in the lock position of FIG. 13 and the release position of FIG. 16 but also in the neutral position of FIG. 14 and the stable position of FIG. 15 by the position restricting means 6. This can be achieved by a spring plate 4' instead of the spring plate 4 and the pivot pin 8 instead of the pivot pin 5.

As shown in FIGS. 17 to 20, the parallel plate portions 42, 42 of the plate spring 4' are each formed with a bent portion 42*a*. A pivotal movement restricting portion 81 of the pivot pin 8 corresponding to the pivotal movement restricting portion 51 of the pivot pin 5 exhibits a hexagonal configuration in section, and it includes three pairs of planar portions 82, 82; 83, 83 and 84; 84. Between the respective adjacent planar portions 82, 83, 84, angular portions 85, 86, 87, which are formed by intersection between the adjacent planar portions 82, 83, 84, are formed. It is also accepted that between the respective adjacent planar portions 82, 83, 84, annular portions for smoothly connecting thereof are formed, respectively.

Figure 17:
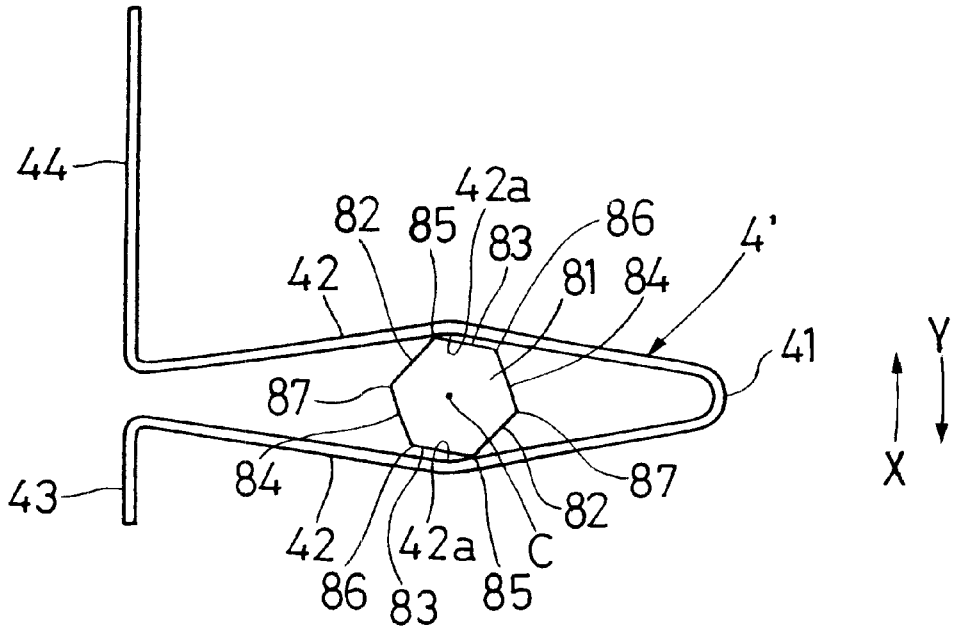
FIG. 17 is a view showing a relation between the plate spring and the pivot pin when the pivotal lever of the second embodiment of the present invention to the lock position.

When the pivotal lever 3 is pivoted to the lock position of FIG. 13, the one pair of angular portions 85, 85 are in contact with the parallel plate portions 42, 42 at the spots offset from the bent portions 42*a*, 42*a* as shown in FIG. 17. In that state, the biasing force of the parallel plate portions 42, 42 are directed to an offset position from the center C of the pivot pin 8 Accordingly, the biasing force of each parallel plate portion 42 acts as a pivotal biasing force for pivoting the pivot pin 8. This pivotal biasing force acts in a direction for pivoting the pivotal lever 3 from the release position side to the lock position side (the direction indicated by an arrow X of FIG. 17). Accordingly, the pivotal lever 3 is brought into abutment with the forced restricting portion 11*a* and maintained in the lock position.

Figure 18:
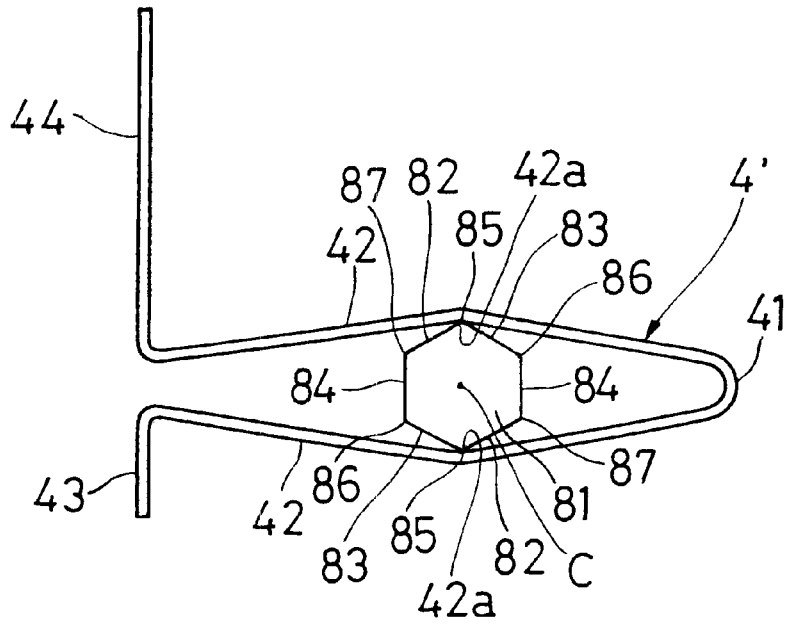
FIG. 18 is a view showing a relation between the plate spring and the pivot pin when the pivotal lever of the second embodiment of the present invention is pivoted to the neutral position.

When the pivotal lever 3 is pivoted a predetermined angle (for example, about 15 to 20 degrees) from the lock position to the release position (the direction as indicated by an arrow Y of FIG. 7) against the biasing force of the plate spring 4', the one pair of angular portions 85, 85 come into contact with the parallel plate portions 42, 42 at the bent portions 42*a*, 42*a* as shown in FIG. 18. In that state, the biasing force of the parallel plate portions 42, 42 is directed to the center C of the pivot pin 8. Accordingly, the biasing force of the parallel plate portion 42 does not act as a force for pivoting the pivotal lever 3 but it merely generates a frictional resistance between the parallel plate portion 42 and the angular portion 85. Due to this frictional resistance, the pivotal lever 3 is maintained in a constant pivotal position.

The pivotal position of the pivotal lever 3 at that time is the neutral position of FIG. 14. When the pivotal lever 3 is pivoted from the neutral position, the parallel plate portion 42 pivotally biases the pivotal lever 3. When the pivotal lever 3 is pivoted from the neutral position to the lock position side, the parallel plate portion 42 pivotally biases the pivotal lever 3 from the release position side to the lock position side, and when the pivotal lever 3 is pivoted from the neutral position to the release position side, the parallel plate portion 42 pivotally biases the pivotal lever 3 from the lock position side to the release position side. Accordingly, in this door guard $G_2$, the angle formed between the lock position and the release position is the return angle.

As shown in FIG. 14, when the pivotal lever 3 is pivoted to the neutral position with the door B held in the shut position, a distal end face (abutment portion) 33*a* of the engagement plate portion 33, which faces the outdoor 0 side, is located on the indoor I side than the head portion 12*b* and faced with the head portion 12*b*. Accordingly, when the door B is swung open from the shut position in the state in which the pivotal lever 3 is pivoted to the neutral position, the distal end face 33*a* is brought into abutment with the head portion 12*b*.

Figure 19:
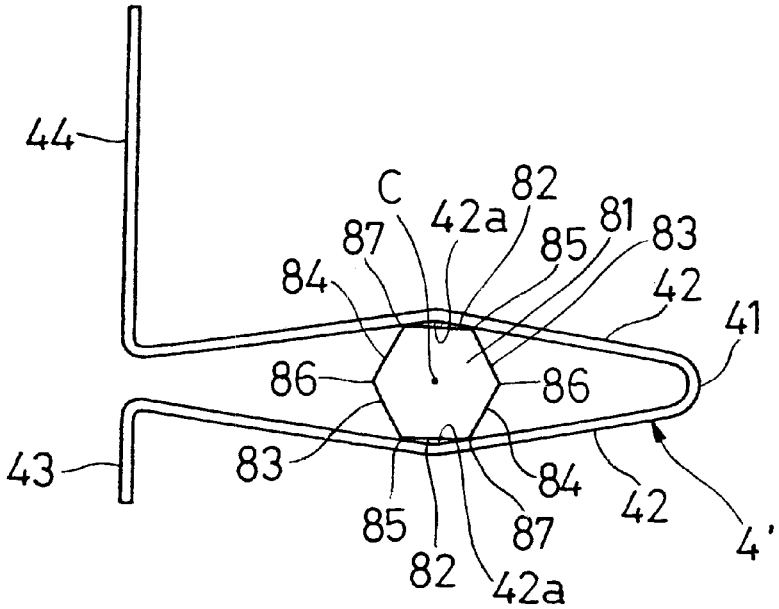
FIG. 19 is a view showing a relation between the plate spring and the pivot pin when the pivotal lever of the second embodiment of the present invention is pivoted to the stable position.

When the pivotal lever 3 is further pivoted a predetermined angle (for example, 30 degrees) from the neutral position, it reaches the stable position of FIG. 15. In the state in which the pivotal lever 3 is pivoted to the stable position, the door B can be swung open from the shut position freely. Moreover, when the pivotal lever 3 is pivoted to the stable position, the angular portion 85 and its adjacent angular portion 87 come into contact with the parallel plate portion 42 simultaneously, with the bent portion 42*a* disposed therebetween as shown in FIG. 19. Accordingly, the pivotal lever 3 is maintained in the stable position with a predetermined amount of force and even if the pivotal lever 3 is slightly pivoted towards the release position side or the lock position side from the stable position side, the pivotal lever 3 is returned to the stable position by the biasing force of the parallel plate portion 42.

Figure 20:
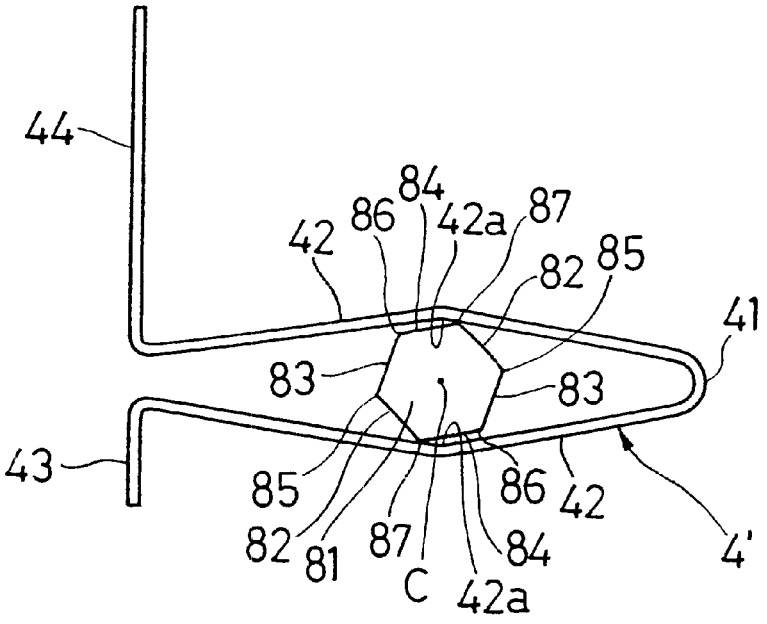
FIG. 20 is a view showing a relation between the plate spring and the pivot pin when the pivotal lever of the second embodiment of the present invention is pivoted to the release position.

When the pivotal lever 3 is further pivoted a predetermined angle (for example, 45 degrees) from the stable position, it reaches the release position of FIG. 16. In the release position, as shown in FIG. 20, the angular portions 87, 87 are in contact with the parallel plate portions 42, 42 at the spots offset from the bent portions 42*a*, 42*a*. Accordingly, the parallel plate portions 42, 42 pivotally bias the pivotal movement restricting portion 81 towards the release position side from the lock position side (direction as indicated by an arrow Y of FIG. 17). By this pivotal biasing force, the pivotal lever 3 is brought into abutment with the door B and maintained in the release position.

According to the door guard $G_2$ thus constructed, it can assuredly be avoided that a person(s) who walks out of the indoor to the outdoor is accidentally shut out in the outdoor.

That is, in the case of the door guard $G_1$ of FIGS. 1 to 12, when the arcuate portion 54 of the pivot pin 5 is contacted with the parallel plate portion 42 at a central portion thereof by pivoting the pivotal lever 3 to a predetermined intermediate position between the lock position and the release position, the biasing force of the parallel plate portion 42 is directed to the center of the pivot pin 5 and therefore, it does not act as a force for pivoting the pivot pin 5 and a frictional resistance is generated between the parallel plate portion 42 and the arcuate portion 54. Due to this frictional resistance, the pivotal lever 3 is maintained in the intermediate position. In the state in which the pivotal lever 3 is in the intermediate position, the door B can be swung open from the shut position freely as in the case where the pivotal lever 3 is in the release position. In the state in which the pivotal lever 3 is in the intermediate position, when the door B is shut after a person(s) gets out of the indoor by opening the door B, the pivotal lever 3 is sometimes pivoted from the intermediate position to the lock position side. The force for maintaining the pivotal lever 3 in the intermediate position is only the frictional resistance and therefore small. In the case the impact, which occurs when the door B reaches the shut position, is large, the pivotal lever 3 is caused to pivot from the intermediate position to the lock position side by the impact. When the pivotal lever 3 is pivoted, even if very slightly, from the intermediate position to the lock position side, the plate spring 4 causes the pivotal lever 3 to pivot from the intermediate position side to the lock position. When the pivotal lever 3 is pivoted to the lock position, the door B is prevented from being swung beyond the half-open position by the door guard $G_1$. For this reason, the person(s) who walked out of the indoor to the outdoor, is shut out in the outdoor.

However, in the door guard $G_2$ of FIGS. 13 to 20, when the door B is swung open from the shut position in the state in which the pivotal lever 3 is pivoted to the neutral position, the distal end face 33*a* is brought into abutment with the head portion 12*b*. If the pivotal lever 3 should be maintained in the neutral position even after the distal end face 33*a* has been brought into abutment with the head portion 12*b*, the door B would not be able to be further swung open. Accordingly, the person(s), who is in the indoor, cannot get out to the outdoor. Thus, the person(s) is never shut out in the outdoor.

It should be reminded that the frictional force between the parallel plate portion 42 and the angular portion 85 is small. Accordingly, when the distal end face 33*a* is brought into abutment with an enlarged diameter portion 23, the pivotal lever 3 is caused to pivot from the neutral position to the lock position side or the stable position side by the impact. Then, the pivotal lever 3 is pivoted to the lock position or the stable position by the plate spring 4.

In the case where the pivotal lever 3 is pivoted to the lock position, the door B is prevented from being swung open from the half-open position by the door guard $G_2$. Accordingly, the person(s), who is in the indoor, cannot get out to the outdoor. Thus, the person(s) is never shut out in the outdoor, either.

On the other hand, in the case where the pivotal lever 3 is pivoted to the stable position, the door B can be swung freely. When the door B is shut after the person(s), who is in the indoor, gets out to the outdoor by opening the door B, the pivotal lever 3 receives a force towards the lock position side due to the impact which occurs when the door B reaches the shut position. However, in the stable position, the pivotal lever 3 is positionally locked by a large force of the plate spring 4. This force is set larger than the pivotal force which the pivotal lever 3 receives from the impact which occurs when the door B reaches the shut position. Moreover, even if the pivotal lever 3 is pivoted slightly to the lock position side, it is returned to the stable position by the plate spring 4. Accordingly, the pivotal lever 3 is never pivoted to the lock position by the impact which occurs when the door B reaches the shut position and the stable position is maintained. Thus, the person(s), who is in the indoor, is never shut out in the outdoor, either.

Figure 21:
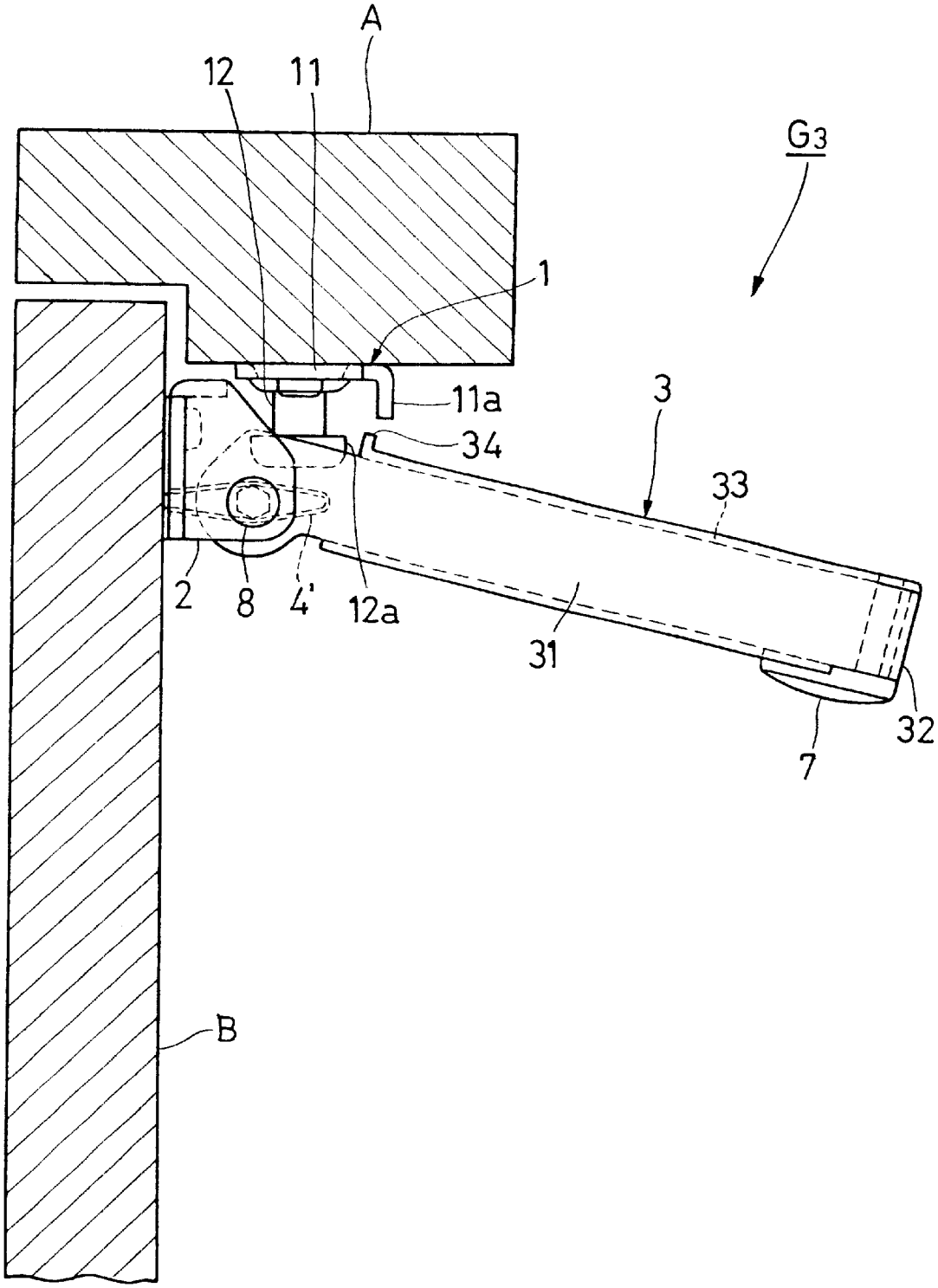
FIG. 21 is a plan of a third embodiment of the present invention, showing a state in which the pivotal lever is pivoted to the neutral position.

FIG. 21 shows a third embodiment of the present invention. In the door guard $G_3$ of this embodiment, a distal end portion of the engagement plate portion 33 is bent at generally right angles to thereby form a projection portion (abutment portion) 34 projecting from the pivotal lever 3 towards the retaining member 2 side. When the door B is swung open from the shut position in the state in which the pivotal lever 3 is pivoted to the neutral position, the projection portion 34 is brought into abutment with the head portion 12*b*. The width of the projection portion 34 in a projecting direction from the pivotal lever 3 is larger than the width of the distal end face 33*a*. Accordingly, the projection portion 34 can assuredly be abutted with the head portion 12*b*. Thus, the person(s), who is in the indoor, is positively prevented from being shut out in the outdoor.

It should be noted that the present invention is not limited to the above embodiments and various modifications can be made where necessary.

For example, in the above embodiments, the pivotal lever 3 is forcibly pivoted from the lock position to the release position side by the forced pivoting portion 11*a* as the door B is swung open. However, it is also accepted that the pivotal lever 3 may be pivoted in the reversed way, i.e., from the lock position to the release position.

Moreover, in the above embodiments, a stable position is provided between a neutral position and a lock position. However, it is also accepted that no stable position is employed. In that case, the stable position or its nearby area may serve as a neutral position.

What is claimed is:

1. A door guard comprising:

a retaining member fixed to a body;

a pivotal lever whose basal end portion is pivotably supported by a door;

position restricting means including biasing means, said position restricting means restraining said pivotal lever both in a lock position and in a release position with predetermined amounts of force exerted by said biasing means, said biasing means biasing said pivotal lever such that said pivotal lever returns to the lock position within a range of return angles from the lock position;

forced pivoting means, when said door is swung from the closed position to the open position in a state in which said pivotal lever is pivoted to the lock position, said forced pivoting means pivoting said pivotal lever within the range of return angles from the lock position against the biasing force of said biasing means as said door is swung open from a closed position and when said door reaches a particular half-open position, said forced pivoting means allowing said pivotal lever to pivot back toward the lock position by the biasing force of said biasing means; and said retaining member being formed with an engagement portion, so that when said pivotal lever, which has been pivoted from the lock position by said forced pivoting means, is pivoted back toward the lock position by said biasing means, said engagement portion is brought into engagement with said pivotal lever to prevent said pivotal lever from moving in a swinging direction of said door.

2. A door guard according to claim 1, wherein said position restricting means includes said biasing means and a pivot pin pivotably supported by said door and nonpivotably disposed on the basal end portion of said pivotal lever, thereby pivotably connecting said pivotal lever to said door; and said pivot pin having first and second position restricting portions which are formed on an outer peripheral surface thereof in such a manner as to be away from each other in a circumferential direction of said pivot pin; and said biasing means restraining said pivotal lever in the lock position by being abutted with said first position restricting portion under the effect of its own biasing force and restraining said pivotal lever in the release position by being abutted with said second position restricting portion.

3. A door guard according to claim 2, wherein two of said first and second position restricting portions are provided, said two first restricting portions are arranged about 180 degrees away from each other in a circumferential direction of said pivot pin and said two second restricting portions likewise arranged about 180 degrees away from each other in the circumferential direction of said pivot pin, and said first and second position restricting portions are alternately arranged in the circumferential direction of said pivot pin.

4. A door guard according to claim 1, wherein said the forced pivoting means includes a forced pivoting portion disposed on said retaining member, and when said door is swung open from a closed position in a state in which said pivotal lever is pivoted to the lock position, said forced pivoting portion is brought into contact with said pivotal lever to thereby pivot said pivotal lever out of the lock position.

5. A door guard according to claim 1, wherein:

when in a neutral position where said pivotal lever is away by the return angle from the lock position toward the release position, said position restricting means restrains said pivotal lever in the neutral position, when said pivotal lever is pivoted from the neutral position toward the lock position, said biasing means biases said pivotal lever toward the lock position, and when said pivotal lever is pivoted from the neutral position toward the release position, said biasing means biases said pivotal lever toward the release position, and said pivotal lever is provided with an abutment portion which is abutted with the retaining member when said door is swung open from the closed position in a state in which said pivotal lever is pivoted to the neutral position.

6. A door guard according to claim 5, wherein said abutment portion projects towards said retaining member.

7. A door guard according to claim 5, wherein said position restricting means restrains said pivotal lever in a stable position between the neutral position and the release position by a biasing force of a predetermined value of said biasing means.

* * * * *